US006887640B2

(12) United States Patent
Zhang et al.

(10) Patent No.: US 6,887,640 B2
(45) **Date of Patent: *May 3, 2005**

(54) ENERGY ACTIVATED ELECTROGRAPHIC PRINTING PROCESS

(76) Inventors: Sukun Zhang, 1248 Winding Ridge Ct., Mt. Pleasant, SC (US) 29466; Rebecca Silveston, 4 Shaftsbury La., Charleston, SC (US) 29401; Ming Xu, 2808 Gaston Gate, Mt. Pleasant, SC (US) 29464

( * ) Notice: Subject to any disclaimer, the term of this patent is extended or adjusted under 35 U.S.C. 154(b) by 22 days.

This patent is subject to a terminal disclaimer.

(21) Appl. No.: 10/085,359

(22) Filed: Feb. 28, 2002

(65) Prior Publication Data

US 2003/0165766 A1 Sep. 4, 2003

(51) Int. Cl.[7] ..... G03G 13/20; G03G 13/14
(52) U.S. Cl. ..... 430/124; 430/126; 347/112
(58) Field of Search ..... 430/124, 108.1

(56) References Cited

U.S. PATENT DOCUMENTS

| | | | | |
|---|---|---|---|---|
| 3,853,778 | A | | 12/1974 | Buckley et al. |
| 3,967,962 | A | | 7/1976 | O'Malley |
| 4,021,219 | A | | 5/1977 | Cooper et al. |
| 4,064,285 | A | | 12/1977 | Mammino |
| 4,066,802 | A | | 1/1978 | Clemens |
| 4,216,283 | A | | 8/1980 | Reiff et al. |
| 4,528,257 | A | | 7/1985 | Polderman et al. |
| 4,694,302 | A | | 9/1987 | Hackleman et al. |
| 4,773,953 | A | | 9/1988 | Hare |
| 4,883,736 | A | | 11/1989 | Hoffend et al. |
| 4,940,644 | A | | 7/1990 | Matsubara et al. |
| 4,952,477 | A | | 8/1990 | Fuller et al. |
| 4,990,424 | A | | 2/1991 | Van Dusen et al. |
| 5,238,998 | A | | 8/1993 | Fuller et al. |
| 5,246,518 | A | | 9/1993 | Hale et al. |
| 5,248,363 | A | | 9/1993 | Hale et al. |
| 5,302,223 | A | | 4/1994 | Hale et al. |
| 5,328,754 | A | | 7/1994 | Yuyama et al. |
| 5,354,639 | A | | 10/1994 | Kasuya et al. |
| 5,364,722 | A | | 11/1994 | Tanikawa et al. |
| 5,431,772 | A | | 7/1995 | DeVries et al. |
| 5,555,813 | A | | 9/1996 | Hale |
| 5,558,969 | A | * | 9/1996 | Uyttendaele et al. ..... 430/124 |
| 5,590,600 | A | | 1/1997 | Hale et al. |
| 5,607,482 | A | | 3/1997 | Olsen et al. |
| 5,645,888 | A | | 7/1997 | Titterington |
| 5,785,790 | A | | 7/1998 | Olsen et al. |
| 5,789,039 | A | | 8/1998 | Biller et al. |
| 5,955,233 | A | * | 9/1999 | Urashima et al. ..... 430/109 |
| 5,978,077 | A | | 11/1999 | Koerner et al. |
| 5,981,077 | A | | 11/1999 | Taniguchi |
| 5,985,503 | A | | 11/1999 | de Beeck et al. |
| 6,017,636 | A | | 1/2000 | Tada et al. |
| 6,103,042 | A | | 8/2000 | Hatada et al. |
| 6,337,169 | B1 | | 1/2002 | Hashimoto et al. |
| 6,341,856 | B1 | | 1/2002 | Thompson |
| 6,500,594 | B2 | * | 12/2002 | Hamano et al. ..... 430/109.4 |
| 6,649,317 | B2 | * | 11/2003 | Wagner et al. ..... 430/124 |
| 2002/0155367 | A1 | | 10/2002 | Silveston |

FOREIGN PATENT DOCUMENTS

| | | | |
|---|---|---|---|
| DE | A 2727223 | | 12/1978 |
| EP | 87303687.5 | | 11/1987 |
| EP | A 466503 | | 12/1991 |
| EP | 93309425.2 | | 6/1994 |
| EP | 94103892.9 | | 9/1994 |
| EP | 95115241.2 | | 4/1996 |
| GB | 2105735 | A | 3/1983 |
| JP | 59067453 | | 10/1985 |
| JP | 61 120171 | A | 6/1986 |
| JP | 62103062 | | 4/1987 |
| JP | A 63296982 | | 12/1988 |
| JP | 06 332242 | A | 12/1994 |
| JP | 07 281476 | A | 10/1995 |
| WO | WO 90/13063 | | 11/1990 |
| WO | PCT/US99/09387 | | 11/1999 |

* cited by examiner

*Primary Examiner*—John L Goodrow
(74) *Attorney, Agent, or Firm*—B. Craig Killough

(57) ABSTRACT

A process for printing images by means of an electrographic or electrostatic device using a toner that is cured by multiple applications of energy. The toner has energy-activated reactive components such as radiation-curable sites and reactive functional groups. An image is formed on a substrate by the toner without materially activating the reactive components. The reactive components are subsequently activated by applying a first energy source to adhere the image to the substrate by cross-linking and bonding the image permanently to the substrate, or by transferring the image to a second substrate. A second energy source is applied simultaneously with, or subsequently to, the first energy source, to promote cohesive strength of the image by cross-linking within the toner particles that form the image. The resulting image is permanently bonded to the substrate, yielding substantially enhanced image durability and fastnesses.

20 Claims, No Drawings

ENERGY ACTIVATED ELECTROGRAPHIC PRINTING PROCESS

FIELD OF THE INVENTION

This invention relates to a printing processes, and is specifically directed to a process of producing a permanent image on a substrate by means of an electrographic or electrostatic printer using a thermally crosslinkable toner that is cured by radiation to promote cohesive strength within the image.

BACKGROUND OF THE INVENTION

In general, textile printing involves substrates with much higher surface roughness, and much higher absorption of liquid inks than paper. Textile printing techniques known in the art for printing onto clothing, other textile materials, and other objects include silk screening, digitally produced sublimation transfers, and mechanically bonded thermal transfers. Of these methods, it is not economical to produce customized products with silk screening printing. Digitally produced sublimation transfer printing is limited to synthetic fibers or pre-treated nature fibers. Finally, direct digital textile printing requires special expensive printing devices to pretreat and post treat the fabric.

Images printed onto garments and other textiles may be permanently bonded or crosslinked to a final substrate to obtain high adhesive strength, and crosslinked within the images to obtain high cohesive strength. Both means of crosslinking are required to provide excellent resistance to chemical processes, such as cleaners or laundry products, and deterioration from normal use. Pure cohesive strength, which mechanically bonds the image to the substrate through internal crosslinking within the printed image, does not permanently bond colorants to textile fibers. Thermal transfers, wherein the ink mechanically bonds to the substrate, are described in Hare, U.S. Pat. No. 4,773,953. The surface bonded image has a substantial 'hand,' with a raised, plastic-like feel to the touch, and relatively poor dimensional stability. In addition, the non-imaged area of the transfer sheet used with the process is transferred to the substrate, without chemical bonding or cross-linking processes (Hatada, U.S. Pat. No. 6,103,042, Koerner, et al. U.S. Pat. No. 5,978,077, de Beeck, et al. U.S. Pat. No. 5,985,503, Clemens, U.S. Pat. No. 4,066,802, Mammino, U.S. Pat. No. 4,064,285, Taniguchi, U.S. Pat. No. 5,981,077, Tada, et al. U.S. Pat. No. 6,017,636, DE-A 27,27,223, EP-A 466,503, JP-A 63296982, WO 90/13063). Olsen, et al. U.S. Pat. No. 5,785,790, Olsen, et al. U.S. Pat. No. 5,679,198, and Olsen, et al. U.S. Pat. No. 5,612,119 disclose a screen-printed support sheet, which may have an embedded layer of microspheres, printed with one or more layers of two-component colors based on polyester resin and an isocyanate hardener. The microspheres may have a reflective layer to allow the transferred image printed thereon to reflect light. If more than one color layer is printed onto the microspheres, then a two-component extender or glue that contains a polyester is covered on top of each color layer. On top of the extender layer or single-color layer is applied a powder of polyester or polyamide elastomer, which is then fused into the color layer. Instead of screen printing, a color copier using a two-component toner may be used for applying the color coatings. The color coatings are subsequently covered with this elastomeric powder, which is then fused into the layer prior to transfer.

Conventional heat-melt thermal printing uses primarily non-active wax or wax-like materials such as hydrocarbon wax, carnauba wax, ester wax, paraffin wax, hot-melt resin, thermoplastic, or polymeric materials, as a heat-melt material. The resulting image has poor permanency since the conventional wax materials are not chemically bonded or otherwise permanently grafted to the substrate, but are temporarily and loosely bound to the final substrate by the melting of wax materials during the transfer process. The resulting image is not durable, with the wax materials being washed away during laundering of textile substrates on which the image is transferred, along with the dyes or colorants that form the image in the thermal ink layer.

The natural tendency of cotton fibers to absorb inks causes an image printed on a cotton substrate to lose resolution and become distorted. Liquid inks, other than sublimation inks, wick or are absorbed by cotton or other absorbent substrates, resulting in printed designs of inferior visual quality, since the printed colors are not properly registered on the substrate. This is especially true when aqueous based ink paste is used for coating and fixing purposes as disclosed in Reiff, et al., U.S. Pat. No. 5,607,482.

Cooper, et al. in U.S. Pat. No. 4,216,283, teach a xerographic process of dry image transfer by means of adhesive toner materials. The electrostatic image is developed with a low melting temperature dry toner composition containing a thermoplastic agent to yield an image that is pressure-transferred to a receptor surface. This process uses both low melting temperature plasticizer and foamable microspheres to treat toner material in order to achieve the adhesiveness between toner and substrate. However, it does not chemically bind the toner to the final substrate, and thus, the image has poor permanency qualities.

Natural fiber substrates must be pretreated to permanently accept sublimation dyestuffs and resist chemical processes, such as cleaners or laundry products, and deterioration from normal use. Pretreatment is performed in the early stage of textile printing, and the pretreated fibers may not be suitable for designs applied at a later stage, which greatly limits commercial applicability. DeVries et al., U.S. Pat. No. 4,021,591 disclose that substrates may be surface treated to improve the quality of images received on cotton or other absorbent substrates. Polymer surface coating allows the ink layer to bond to the substrate, and reduces the absorbency of the ink by the substrate thereby improving the image quality. However, grossly coating the substrate results in excess margins which extend beyond the image, and which can be seen with the naked eye, and which add hand to the fabric. The excess coating reduces the aesthetic quality of the printed image on the substrate. Furthermore, the coating tends yellow with age, which is undesirable on white and other light colored substrates. Yellowing is accelerated with laundering, exposure to heat, chemicals, sunlight, or other harsh conditions.

Hale, et al., U.S. Pat. No. 5,431,501, reduce the hand by printing a surface preparation material over the entire image on an intermediate substrate, but not beyond the boundaries of the image. The image is then transferred from the medium to the final substrate by applying heat and pressure, so that the surface preparation material permanently grafts the ink solids to the substrate.

In electrophotographic recording processes, a "latent charge image" is produced on a photoconductor. This image is developed by applying an electrostatically charged toner, which is then transferred to substrates such as paper, textiles, foils or plastic. The image is fixed by the application of pressure, radiation, or heat, or the effects of solvents. (L. B.

Schein, *"Electrophotography and Development Physics"*; Springer Series in *Electrophysics* 14; Springer-Verlag, 1988).

Hale, et al., U.S. Pat. No. 5,555,813 and Hale, et al., 5,590,600 describe a process of producing images electrostatically using sublimation toner. The images are printed onto a paper substrate, and are subsequently heat transferred onto a substrate comprising polyester at about 400° F. In sublimation transfer printing, solid dyes change to a gas at about 400° F., and have a high affinity for polyester at the activation temperature. Once the gasification bonding takes place, the ink is printed with substantial permanency, and is highly resistant to fading caused by environmental exposure, such as to light, or exposure to certain common chemical processes, such as cleaners or laundry products. However, these applications yield excellent results only when a synthetic material substrate is used, since these dyes have a limited affinity for other materials, such as natural fabrics like cotton and wool.

Conventional electrographic toners typically comprise a polymeric binder resin, a colorant, charge control additives, surface additives, waxes, and optionally, a magnetic material. The binder resins are chosen to be highly chargeable, and bind an image to a substrate at an appropriate softening point (approx. 100.degree. C.). The resins must not contaminate the photoreceptor, while allowing easy cleaning of the photoreceptor. Qualities of the resins are that they are non hygroscopic, disperse the colorant, provide good shelf stability, and are readily processed by a pulverizer. The glass transition temperature is usually between 50° C. to 70° C. If the glass transition temperature is lower than 40° C., the toner shelf life is reduced. Alternatively, if the glass transition temperature exceeds 80° C., the fixing temperature rises, and the process qualities of the toner particles is reduced. Further, if the softening point is less than about 100° C., the toner readily adheres to the printer components, such as the developer or the doctor blades in nonmagnetic, monocomponent developing devices, and the toner susceptible to flocculation and the like, leading to reduced shelf life. The Tg of the polymeric resin is chosen to balance fixing qualities with toner free flow stability and shelf life. Radiation curing or photoinitiating, such as UV-curing, is known in conventional printing and coating arts. These cross-linking reactions occur at a low temperatures and cure rapidly on a heat sensitive substrate. Often, in conventional printing and coatings, a UV-curing system comprises photoinitiators, UV-curable oligomers, and optional dilutes (UV-curable or non-UV-curable). These systems are usually liquids, or they have such a low glass transition temperature, that they are not useful in electrographic or electrostatic printing methods. Conventional UV printing compounds and coatings often generate hard and brittle glossy coatings, due to high cross-linking density, which are not desirable properties in textile printing. Typical UV-curable coatings utilize less energy and significantly less curing time at lower temperature than do thermal curable coatings. Biller, et al., U.S. Pat. No. 5,789,039 describe radiation-curable powder coatings for heat sensitive substrates. The coating composition described therein comprises a cationically catalyzed epoxy resin, a vinyl ether type photopolymerizable resin, a solid plasticizer and a photoinitiator that can generate cationic species. The cross-linked epoxy novolac resins therein have higher stiffness and result in poor "hand" on textile fabrics.

The use of heat by electrographic devices such as laser printers and photocopiers presents the problem of printing heat activated dyes, as recognized in Hale, U.S. Pat. Nos. 5,246,518, 5,248,363 and 5,302,223, when these dyes are to be printed in a non-activated form. Laser printers and photocopiers commonly use relatively high temperature fuser devices to thermally fuse or bind the ink to the substrate, since these devices anticipate that the image will be permanently bonded to the substrate which is printed by the device, and do not anticipate the desirability of subsequent thermal transfer of the image from the printed substrate.

The use of an energy-activated toner on untreated textile substrate is disclosed in Wagner et al., U.S. application Ser. No. 09/978,190. A permanent image is obtained on a textile substrate by printing an energy-activated toner. The energy-activated toner provides high adhesive strength between a final substrate and the toner, and high cohesive strength within toner. To achieve the adhesive bond, the energy-activated toner comprises reactive materials that form covalent bonds with a final substrate, upon activation by the application of energy. The energy-activated toner comprises components having lower molten viscosity that are able to penetrate into an absorbent final substrate, such as natural fiber substrates. Covalent bonding within the image layer that has penetrated into the substrate provides cohesive strength and binds the image to the substrate. To prevent premature crosslinking reaction during printing, the reactive components or groups in the toner are blocked with blocking agents. Heat is used to activate the toner, and covalent bonds are formed between the toner and a final substrate, or between the components of the toner. The energy level needed to bond the toner to final substrates, such as natural fiber substrates, is high, which may cause problems with heat sensitive substrates that tend to yellow or scorch when exposed to relatively high levels of heat energy.

Radiation-curable toners in the form of microcapsulated toner particles may provide resistance to image quality depreciation. A hard polymer shell encapsulates radiation-curable ingredients, which may be liquid. For example, Inaishi, U.S. Pat. No. 5,470,683, describes microcapsule photosensitive toners, whose hard shell breaks after fixing. A curable compound in the core is polymerized by low energy visible light. UV curing technology is also used with transfer toners. Hyde, U.S. Pat. No. 5,565,246, and Held, U.S. Pat. No. 5,275,918, disclose non-electroscopic thermography printing.

Meutter, et al., U.S. Pat. No. 5,905,012, disclose the use of radiation-curable toner to produce high gloss toner images that are resistant to depreciation from external physical influences. Solid materials are suggested therein for use in the UV-curable toner. Meutter et al, U.S. Pat. No. 5,888,689, describe a method producing a cross-linked fixed toner image by using reactive groups that are present in a toner, and reactive groups that are present in a substrate. The glass transition temperature of the resin is above 35° C.

Takama, U.S. Pat. No. 5,822,671 discloses printing a resin-formed image onto a recording medium, such as cloth, followed by treating the recording medium with a plasticizer solution in order to improve the "hand" of the image. The plasticizer penetrates between the resin molecules, thereby imparting pliability to the fabric.

Thompson, U.S. Pat. No. 6,143,454, discloses a dye sublimation toner having high molecular weight, cross-linked polymer resins that neither melt nor become tacky at temperatures needed to sublimate disperse dyes. It is reported that the toner itself does not transfer, while the disperse or sublimation dyes transfer from the intermediate sheet to the final polyester substrate, theoretically reducing the hand. However, a high molecular weight cross-linked resin may not fuse sufficiently to the intermediate sheet, since the resin does not necessarily melt at a fuser roller temperature that is lower than the sublimation temperature.

These techniques suffer various drawbacks, such as requiring specially coated substrates, producing images that suffer from excessive "hand", relatively low resolution, relatively low imaging speed, poor image quality, vibrancy, and/or permanency when the image is transferred to a fibrous natural material such as cotton or wool. Accordingly there remains a need for a digital printing process using inks or toners, and methods for making same, that provides, for example, satisfactory electrostatic and physical properties of the toners during the printing of an image to an intermediate substrate before permanently affixing the image onto a fibrous natural or synthetic substrate with good quality, vibrancy, permanency and little 'hand'.

SUMMARY OF THE PRESENT INVENTION

The invention provides a method of electrographically or electrostatically printing and transferring a toner image onto a substrate, including a textile substrate, through an energy-activation process. The resulting image has excellent resistance to depreciation resulting from use of the substrate and from exposure to chemical processes, such as cleaners or laundry products. The invention produces a permanent image on textile substrates, both natural and synthetic. The toner of the invention may comprise energy-activated components that may be activated or cured exposure to multiple energy processes, such as heat and radiation. The toner may remains in a thermoplastic form during printing, and subsequently cross-link or bond with a textile substrate, while the toner particles cross-link or bond with other toner particles to form a thermoset or crosslinked polymer upon activation by exposure to energy.

The energy-activatable components may have multiple reactive species, including those that react with active hydrogen upon application of energy, or those that contain active hydrogen, or are capable of conversion to active hydrogen containing groups. The multiple reactive species also include ethylenic unsaturated sites, or epoxy groups that undergo polymerization when exposed to a radiation source. The energy-activatable species may be on one or more chemical structures.

The invention includes a method of digitally printing and transferring an image to a textile substrate, with the image having improved "hand" and controlled gloss, while also providing excellent toner development and process abilities. The energy curable toner may be solid with a glass transition temperature of below 50° C., and preferably below 40° C. To produce the desired flexibility and "hand" of the image on a textile substrate, the toner may comprise at least one radiation-curable crystalline or semicrystalline resin, such as unsaturated polyester polymer or oligomer, urethane vinyl ether resin, or epoxy having a glass transition temperature of less than 35° C., and having a melting point between 25–150° C., to produce low viscosity and adequate toner penetration into the substrate.

The invention provides for prevention of the premature or undesired reaction of some or all of the reactive groups in the energy activated toner, by protecting these groups. The protective properties are removed by the application of energy after printing.

A radiation source reduces the required transfer/fixing energy level, such as by reducing the heat input to the substrate, to reduce degradation of the substrate from oxidation or scorching. The radiation provides completion of the chemical reaction and permanent bonding of the image to the substrate.

DETAILED DESCRIPTION OF THE PREFERRED EMBODIMENT

In a preferred embodiment, a video camera or scanning device is used to capture an image. The image is then input into a computer. Alternatively, a computer may create the image, or the computer may modify the captured image. The computer directs an electrographic device, such as a laser printer or photocopier, to print the image. Any means of creating or forming an image could be used, such as software generated images. Available computer design graphic software may be used, or still photography may be used. The design may be photographic, graphic/artistic, or simply letters or words. The use of cyan, yellow and magenta toner compositions allow the printer to print multi-color designs as directed by the computer. Black toner may be used. In addition, spot colors may be used to increase the color gamut or imaging efficiency.

Electrophotographic and electrostatic printing devices are designed for imaging on limited type of substrates such as paper or other thin sheets of material. These materials have surface the characteristics and flexibility suitable for a printable substrate. Other materials, including fibrous textiles, metals, and smooth plastics, do not possess the appropriate shape, or the appropriate physical and/or chemical properties, or do not provide acceptable image adhesion required for image permanency, that will permit such materials to be used as substrates that are printable by electrophotographic and electrostatic devices. Electrographic devices are not designed to handle and print directly upon either rigid or highly flexible materials without significant modification of the device, if at all.

In a preferred embodiment of the present invention, energy-activated electrographic toners or inks are used to produce an image on a transfer substrate or final substrate. The substrate may be a textile substrate. Preferably, at least two energy sources are used as part of the process. The energy sources may be heat and radiation applied simultaneously or separately. The toner or ink may comprise one or more combinations of heat and radiation curable components, thermoplastic resins, a colorant, one or more photoinitiators, one or more thermal initiator, wax, a heat-activated printing additive, an external additive, and an internal additive. The resulting permanent image has excellent adhesion properties, cohesive strength within the image material, improved fastnesses, controlled 'hand', and is energy efficient. Three dimensional and oddly shaped objects, which cannot be directly printed upon by the digital printer, can be imprinted by transferring the image from a transfer substrate, such as paper, that is directly printed upon by the printer.

Other forms of energy may also be used to activate and/or fix the toner or ink, including sound, ultrasound, infrared, radio waves, x-ray, electron bean (gamma ray), or the like. The curable, energy-activated components may comprise both radiation-curable and heat-curable reactive functional groups, either within the same molecular structure, or separately.

The reactive functional groups include amine, amido, carboxylic acid, hydroxyl, thiol, urethane, or urea groups or functional groups that can be converted into active hydrogen containing functional groups, such as carboxylic acid derivatives, or, for example, anhydride groups including anhydride of chlorinated polyolefin polypropylene (CPO). The availability of the heat-activated functional groups enhances the reactivity of the toner or ink, increasing both the cohesive forces and the adhesion between the toner, or ink, and the final substrate, as the image is permanently bonded to the substrate during the activation process. This property is especially effective when the final substrate contains functional groups such hydroxyl, carboxylic acid, or other active hydrogen-containing groups.

The heat and radiation dual-curable embodiment of the toner or ink is comprised of at least one radiation-curable species. The toner or ink may comprise ethylenic unsaturated sites, which undergo free radical polymerization that is initiated by a photoinitiator upon exposure to a radiation source, Alternatively, the toner or ink may comprise epoxide groups, which undergo cationic curing upon exposure to a radiation source, in which case a positively charged chemical species are the primary mechanism for curing the resin. The radiation curing may be performed simultaneously with heat curing, such as during transfer of the image, or radiation may be subsequently applied to enhance the cohesive force within the image, and to improve the imaging quality, durability and 'hand.'

It is desirable to have both heat and radiation curable functionalities in one chemical structure. Examples of such chemicals include, but are not limited to, carboxyl or hydroxyl terminated unsaturated polyesters, epoxide group terminated unsaturated epoxy-polyesters, isocyanate group terminated urethane vinyl ether, or isocyanate groups terminated urethane (meth)acrylate or the like. The dual-curable resin may also be comprised of at least one reactive group, preferably an electrophilic cross-linking species, which is capable of cross-linking the nucleophilic compounds through active hydrogen containing groups, such as amine, amido, carboxylic acid, hydroxyl, thiol, urethane, or urea groups or functional groups that can be converted into active hydrogen containing functional groups, such as carboxylic acid derivatives, for example, anhydride groups. The heat and radiation-curable resins typically have a weight average (Mw) molecular weight ranging from 200 to 500, 000, and preferably in the range of 400 to 100,000. The degree of unsaturation or epoxy group ranges from 2 to 25% by weight and preferably between 3 and 15% by weight. Depending upon the application and the final substrate used, the molar ratio of radiation-curable sites to heat activated reactive functional groups may range from 100:1 to 1:100, and is preferably between 10:1 to 1:10.

The dual-curable component or resin used in the present invention may be produced by a condensation reaction of unsaturated di- or polyfunctional carboxylic acids (or their anhydrides) with di- or polyhydric alcohols to form carboxyl or hydroxyl terminated unsaturated polyester; or with hydroxyl functional (meth)acrylates to form carboxyl or hydroxyl terminated unsaturated (meth)acrylate; or with di- or poly- epoxy to form epoxy group terminated unsaturated epoxy-polyesters; or with di- or poly- isocyanates to form isocyanate group or carboxyl group terminated unsaturated polyurea or polyamide. The dual-curable resin may also be produced by a condensation reaction of di- or polyhydric (meth)acrylates with di- or poly-isocyanates to form isocyanate group or hydroxyl terminated urethane-(meth) acrylate; or with di- or poly- epoxy to form epoxy or hydroxyl terminated (or hydroxyl terminated) epoxy-(meth) acrylate. The resin may also be an acrylated melamine resin formed by a condensation reaction of acrylamide with a fully alkaylated co etherified melamine resin. Examples of typical ethylenically unsaturated di- or polyfunctional carboxylic acids (or their anhydrides) include maleic anhydride, fumaric acid, itaconic anhydride, citraconic anhydride, mesaconic anhydride, aconitic acid, etc. Examples of dihydric (meth)acrylates include hydroxylethyl (meth )acrylate, hydroxylpropyl (meth)acrylate, glycerol-monomethacrylate (MHOROMER D1132 from Rohm America), and dihydric dimethacrylate (CN-132 from Sartomer). Typical epoxide type resins would be those related to bisphenol A diglycidyl ether epoxies, butyl glycidyl ether, and epoxy Novolacs. Examples of typical diisocyanates include toluene diisocyanate (TDI), Hexamethylene diisocyanate (HMDI), isophorone diisocyanate (IPDI) and diphenylmethane diisocyanate (MDI).

In another embodiment of the present invention, the heat and radiation dual-curable species is present in two separate chemical structures, where one resin is radiation-curable, and the other is heat-crosslinkable. The radiation-curable resin is preferably comprised of at least one radiation-curable species, such as an ethylenic unsaturated site or an epoxy group. The resin may be chosen from ethylenic unsaturated epoxies, ethylenic unsaturated urethane, ethylenic unsaturated polyesters, epoxy-(meth)acrylates, urethane (meth)acrylates, polyester (meth)acrylates, polyether (meth)acrylates, vinyl (meth)acrylates, polyene thiol systems, and acrylated melamines. polyene/thiol systems (polyol/polythiol, or thiol/polyene) and epoxide novolac resins. The radiation-curable resin typically has a weight average (Mw) molecular weight ranging from 200 to 10,000, and preferably in a range from 400 to 5,000. The degree of unsaturation or epoxy group ranges from 2 to 25% by weight, and is preferably between 3 and 15% by weight. The heat-curable resin preferably comprises at least one highly reactive functional group, an electrophilic cross-linking species, which is able to cross-link the nucleophilic compounds through active hydrogen containing groups, such as amine, amido, carboxylic acid, hydroxyl, thiol, urethane, or urea groups or functional groups that can be converted into active hydrogen containing functional groups, such as carboxylic acid derivatives, for example, anhydride groups. The preferred electrophilic species in the heat-crosslinkable resin is selected from the group consisting of aldehyde groups, hydroxyl groups, carboxyl groups, amino groups, isocyanate groups, epoxy groups, anhydrides, isothiocyanantes, aminoplast crosslinkers, amine groups, mercapto groups available for reaction through certain initiation processes, such as blocked polyisocyanates, internally blocked (sometimes referred to as blocking agent-free) isocyanate or polyisocyanates, or encapsulated polyisocyanates, which may be initiated by the application of heat. The heat-crosslinkable resin has a weight average molecular weight ranging from 200 to 10,000, and preferably in a range from 400 to 5,000.

The nucleophilic compounds can be provided by toner components, such as colorants, binders, and other additives. A final substrate containing active hydrogen, such as hydroxyl groups (cotton), amino groups (silk), or thiol groups (wool), may contribute, fully or partially, to the high adhesive strength via the binding process to form covalent bonds and provide binding sites for the final image. Resins with one or more functional groups containing active hydrogen are preferably used as both nucleophilic compounds and binder materials. Examples of functionalized resins are carboxylated polyester resins, homo-polymerized or co-polymerized, with about 2.0 equivalents of carboxyl groups and an average molecular weight above 3,000. Such carboxylated polyesters can be linear, branched, or cross-linked with an acid number between about 1 and about 100 mg KOH/g. Other examples of resins containing active hydrogens are hydroxylated or amino functionalized polyesters with a hydroxyl number of 10–200 mg KOH/g, preferably 20–120 mg KOH/g. Examples are Albester 3100 hydroxylated polyester (McWhorter), Crylcoat 291 hydroxylated polyester resin (UCB Chemicals), A-C 645 oxidized ethylene-based polymer (Honeywell) and Lexorez 1110-110 polyester polyol (Inolex). For applications where disperse or sublimation dyes are used as colorants, functionalized polyester resins are especially preferred in the present invention because of their high affinity to these colorants. Examples of other binders with one or more functional groups containing active hydrogen include polyols. In general, polyols or mixtures thereof may have an average molecular weight between 1,000 and 100,000, and preferably between 3,000 and 20,000. One skilled in the art will realize that other hydroxyl-containing materials may be used without departing from the spirit of the present invention. Other suitable active hydrogen-containing functional groups include amino, thiol, carboxylic acid and anhydride groups, and multi-functional compounds containing more than one different functional group. Other examples of materials having active hydrogen functional groups are sugar saccharides, polysaccharides and carbohydrate derivatives. Examples include cellulose and its derivatives, such as hydroxyethyl cellulose and hydroxypropyl cellulose, carboxymethlycellulose, glucose, cyclodextrin, starches, and their derivatives. The prefer molar ratios of electrophilic highly reactive function group to nycleophilic, such as COOH/OH, epoxy/OH (or COOH), and isocyanate (NCO)/OH (or COOH) etc. are 0.01:1 to 100:1 and preferably 0.1:1 to 1:10 in order to obtain a resin with highly active end groups, which undergo the curing process.

The heat and radiation dual-curable toner or ink embodiment of the invention may be comprised of a diluent or crosslinking resin containing mono-, di-, and polyfunctional ethylenic unsaturated sites or multi-functional epoxide groups, and acting as a diluent to reduce the viscosity of the formulated mixtures, and to promote rapid curing. The crossslinking resin may cross-link with the above radiation-curable resin via free radical polymerization initiated by a photoinitiator upon exposure to radiation source, or via cationic polymerization. Examples of such diluents include ethylenically unsaturated vinyl ether, vinyl ester, allyl ether, ally ester, N-vinyl caprolactam, N-vinyl caprolacton, acrylate or methacrylate monomers. The examples of such resin may also include oligomers of epoxy acrylates, urethane acryaltes, unsaturated polyesters, polyester acrylates, polyether acrylates, vinyl acrylates, polyene/thiol systems. It is preferred that the resin is in a solid form to ensure toner powder stability. Examples of solid monomer as a diluent include maleic anhydride, fumaric acid, N-vinyl-2-pyrrolidone (such as V-PYROL from ISP), N-Vinyl-2-Caprolactam (such as V-CAP from ISP), PC304 methacrylate functional monomer from Sartomer. Examples of solid oligomers include unsaturated polyesters, e.g. Uvecoat series from UCB Chemicals, and Uracross series from DSM, maleate/vinyl ether, e. g. Uracross FD2014 from DSM, vinylether urethane, e. g. Uracross P3307 from DSM and urethane (meth)acrylate, etc. The radiation-curable resins typically have a weight average molecular weight ranging from 200 to 4,000, and preferably in a range from 400 to 2,500. The degree of unsaturation or epoxy group ranges from 2 to 25% by weight, and preferably between 3 and 15% weight. Depending on a specific application and final substrate, the equivalent ratio of radiation-curable components to heat activated reactive functional components may range from 100:1 to 1:100, and preferably between 10:1 to 1:10.

Thermoplastic polymeric or resinous materials with zero to low functionality may be incorporated into the toner to enhance toner colorant dispersion, toner penetration to the final substrate, and desired thermal and mechanical properties, such as the image vibrancy, durability and process ability. It is preferred that the resin has molten temperature lower than the temperature of heat activation in order to yield image vibrancy and durability, and high tensile strength and hardness for to improve processing during pulverization or micronization. It is preferred that the resin is a crystalline material. An average molecular weight preferably ranges from 2,000 to 500,000, the glass transition temperature ($T_g$) from −50° to 120° C., and the melting temperature ($T_m$) from 25° to 150° C., which provides a final image an excellent "hand" and vivid color, when used multi-color images are produced. Examples of resins include, but are not limited to, polyester, EVA, hot melt adhesives, polyamide resins, polyolefin resins, homopolymer of styrene and substituted styrene such as polystyrene, poly(p-chlorostyrene), polyvinyltoluene; and styrene copolymers such as styrene-vinylnaphthalene copolymer, styrene-acrylonitrile copolymer, styrene-vinyl methyl ether copolymer, styrene ethyl ether copolymer, styrene vinyl methyl ketone copolymer, styrene-butadiene copolymer, styrene-butadiene-styrene block copolymers, styrene-isoprene copolymer, styrene-acrylonitrile-indene copolymer. Other acceptable resins may include polyvinyl chloride resins, aliphatic hydrocarbon resins, acrylic chlorinated paraffin and paraffin waxes. Generally, the toner composition will comprise from 0 to 80% by weight of the combined resin materials. Preferably, the toner composition will comprise between 10% by weight 50% by weight of the combined resinous materials.

The present invention can be used with both dry and liquid electrographic printing processes, including xerographic printing methods. It is preferred to use a resinous material with a controllable crystallinity in the dry toner. In conventional electrographic printing, crystalline materials are not desirable because of problems associated with fusing of the image onto the printed media. For example, crystalline material may exhibit poor fusing latitude, uncontrollable quick fusing and large dot-gain, especially with high temperature fusing devices. The dual-curable toner or ink in present invention takes advantage of crystalline properties of the material. Increased crystallinity of the toner or ink materials improves tensile strength, flexural modulus and hardness of the toner particle materials, thereby improving the process qualities of the material. Reactions between the toner components, both during heat energy and radiation applications, inhibit crystallization of the material. Further, the reactivity of such components increases as the crystalline material liquefies through the fixing or curing process. Crystalline material is especially suitable for transfer printing onto fibrous textile material, due to its quick melting, and therefore, quick penetration into the textile substrate. This property enhances the adhesion between the image and the substrate, and cohesion of the toner and ink materials. The quick heat response of the material during heat transfer and activation also allows the remaining crystal resinous material to be converted into an amorphous form, with improved mechanical impact resistance, less shinkage and better flexibility of the image on the final substrate.

By "controllable crystallinity", it is meant that the degree of crystallinity of the material can be controlled through physical processes such as the application of heat and/or pressure, as well as through chemical processes, such as crosslinking. The dry toner used in present invention is selected to have a sufficiently low glass transition temperature to ensure a sufficiently low viscosity in the molten state according to the substrate to be printed upon. Materials or resins with controlled crystallinity provide quick penetration into an absorbent substrate, such as a textile, before the curing or crosslinking reaction occurs. The resulting image on a textile substrate has an excellent "hand", excellent color vibrancy and excellent wash fastness. It is also preferred that the toner have sufficiently high powder stability to avoid agglomeration or caking during preparation, processing, handling, transportation and storage. Unlike conventional toners with glass transition temperatures ranging between 55° C. and 65° C., the heat and radiation dual-curable toner may have a glass transition temperature of less than 50° C., and preferably less than 35° C. To obtain the required low glass transition temperature, and maintain flow powder at temperatures encountered during preparation, processing, handling, transportation and storage, the crystallinity needs to controllable as a function of temperature. High crystallinity is required during the pulverization process, while low crystallinity is desired after fixing the image on the substrate. Furthermore, oligomers or polymers, may be used in the present invention as components of the dual-curable toner. Crystalline oligomers or polymers in the present invention may provide low viscosity in molten state, and solidify when a temperature is below their melting point and above their glass transition temperature. The toner containing the crystalline oligomers or polymers may also provide good powder stability and better flexibility with low gloss and low surface hardness. Through the use of crystalline resins in the present invention, the desired "hand" and color vibrancy can be achieved, without sacrificing toner powder stability. To obtain the desired "hand," while providing sufficient wash fastness, a low radiation curing power requirement, and good color vibrancy on textile substrates, it is preferred that the toner to comprise oligomers, prepolymers, or polymers with controllable crystallinity, yielding glass transition temperatures of below 35° C., and melting points above the glass transition temperatures of the non-crystalline ingredients, of between 60° C. and 180° C. Materials with crystallinity between 2 to 80% may be used, with a preferred range from 10 to 50% To achieve a sufficiently low viscosity upon melting to flow in a period of 10 to 50 seconds, at temperatures between 200° F. and 400° F., the toner compositions are preferred to contain 5 to 90% by weight of crystalline resins, and preferably between 20 and 80%, whether such resins are in the form of radiation-curable resins, diluent, or thermoplastic resins, The toner may comprise crystalline resins that are supplied by a radiation-curable resin or diluent, or a thermoplastic resin. The radiation-curable crystalline unsaturated carboxyl or hydroxyl terminated polyesters may be composed of a crystalline unsaturated di- or polyfunctional acid, or its anhydride, reacting with a straight-chain di- or polyhydric alcohol. A suitable example of the crystalline carboxylic acids is phthalic anhydride. Epoxide group terminated unsaturated epoxy oligomer can be prepared by reacting crystalline epoxy resin with unsaturated di- or polyfunctional acid or its anhydride, or reacting with crystalline a di-hydroxyl vinyl ether, and further reacting with a di-or polyhydroxyl-functional (meth)acrylate. The isocyanate group terminated vinyl ether, or isocyanate group terminated (meth)acrylate can be prepared by reacting crystalline di- or polyisocyanate with di-hydroxyl vinyl ether, and further reacting with a di-or polyhydroxyl-functional (meth) acrylate. Examples of crystalline isocyanates include hexamethylene diisocyannate, hydrogenated methylene bis (cyclohexyl) diisocyanate, or biurets or uretdiones thereof. Examples of dihydroxyl-functional (meth)acrylates include, but are not limited to glycerolmonomethacrylate (MHOROMER D1132 from Rohm America), and dihydric dimethacrylate (CN-132 from Sartomer), hydroxyethyl methacrylate and hydroxypropyl methacrylate. Example crystalline UV-curable oligomers include Uvecoat 9000 from UCB Chemicals, and Uracross P 3307 from DSM.

Advantages may be presented when the thermoplastic resin is a solid, with a glass transition temperature of less than 50° C. The resin is preferred to be crystalline material with a glass transition temperature less than 30° C., and a melting point range of between 35 and 180° C. Examples of the resin include crystalline thermoplastic polyesters, crystalline thermoplastic elastomers, flouorpolymers, ethylene vinyl acetate (EVA), polyacrylate-styrene copolymers, crystalline polyolefin, functionalized polyolefin, nylon and the like. Examples of the crystalline resin include thermoplastic polyester, such as Eastar Bio 14766 with a glass transition temperature of −30° C. and a melting point of 110° C.

In one embodiment, a toner or ink is produced that comprises a photoinitiator and/or a co-initiator that is chosen from those commonly used for radiation curing purposes. The appropriate photoinitiators which can be used in the present invention are direct cleavage (Norrish I or II) photoinitiators including benzoin and its derivatives, benzil ketals and its derivatives, acetophenone and its derivatives, hydrogen abstraction photoinitiators including benzophenone and its alkylated or halogenated derivatives, anthraquinone and its derivatives, thioxanthone and its derivatives, and Michler's ketone. Examples of photoinitators which may be suitable for the present invention are benxophenone, chlorobenzophenone, 4-benzoyl-4'-methyldiphenyl sulphide, acrylated bensophenone, 4-phenyl benzophenone, 2-chlorothioxanthone, isopropyl thioxanthone, 2,4-dimethyl thioxanthone, 2,4 dichlorothioxanthone, 3,3'-dimthyl-4-methoxybenzophenone, 2,4-diethylthixanthone, 2,2-diethoxyacetophenone, a,a-dichloroaceto,p-phenoxyphenone, 1-hydroxycyclohexyl actecophenone, a,a-dimethyl,a-hydroxy acetophenone, benzion, benzoin ethers, benzyl ketals, 4,4'-dimethyl amino-benzophenone, 1-phenyl-1,2-propane dione-2 (O-ethoxy carbonyl) oxime, acylphosphine oxide, 9,10-phenantrene quinine and the like. It may optionally be beneficial to use a photoactivator, such as tirethanolamine, methyl diethanolamine, ethyl 4-dimethyl aminobenzoate, 2(n-butoxy)ethyl 4-dimethylamino benzoate, 2-ethyl hexyl p-dimethyl-aminobenzoate, amyl p-dimethyl-aminobenzoate, tri-isopropanolamine and the like. Photoinitiated cationic polymerization uses salts of complex organic molecules to initiate cationic chain polymerization in oligomers or monomers containing epoxides. Cationic photoinitiators include, but are not limited to diaryliodonium and trarylsulfonium salts with non-nucleophilic complex metal halide anions. Among these examples, it is further advantageous when the photoinitiators or co-initiators used in present invention contain reactive functional groups such as active hydrogen that enable heat activated reactions. The toner compositions may contain 0–20% by weight of photoinitiators, and preferably contain 0.5 to 10% by weight.

In order to enhance the radiation cure efficiency, and hence the image quality, photoinitiators or co-initiators having different wavelength sensitivity may be printed from separate ink or toner reservoirs, or from multiple ink or toner reservoirs. This process desirable when multiple layers of toner or ink material are applied to form an image, and where each layer has a different cure time for completing the reaction. For example, a photoinitiator curable at 200 nm may be used for the first layer of toner, and a second photoinitiator curable at 250 nm may be used for the second layer of toner. By applying ultraviolet radiation at 200 nm to 250 nm, both layers of toner or ink may be cured simultaneously and effectively, without the layers interfering with each other. Similarly, varying quantities of photoinitiators or co-initiators can be added to the toner or ink reservoirs. Examples of these photoinitiators include bis-acylphophine oxide (BAPO) and alpha-hydroxy ketone (AHK).

The heat and radiation dual-curable toner compositions may comprise thermally decomposable initiators. Radiation curing, such as curing by exposure to ultraviolet radiation, occurs on top of the image, which results in incomplete curing underneath the top surface of the image. Thermal initiators will decompose during heat curing or cross-linking, and initiate polymerization. Suitable initiators include hydrogen peroxides, and azo compounds. Thermal initiators may be used in a quantity of 0 to 10% by weight, and preferably 0 to 5%.

A thermal initiator may be applied to a final substrate, which may be a cellulose substrate. Cellulose will undergo a free radical graft polymerization with toner when initiated by thermal initiators, bonding the toner with the substrate and providing adhesion of the image the substrate.

Any radiation source that can generate a reaction to initiate polymerization may be utilized in present invention. These radiation sources include ultraviolet (UV), electron beam (EB), infrared (IR), laser, ultraviolet laser, infrared laser, microwave, visible light and radio frequency radiation. Suitable UV sources include, but are not limited to, low pressure mercury vapor lamps, medium pressure mercury vapor lamps, high pressure mercury vapor lamps, metal halide lamps, electrodeless lamps, xenon lamps, ozone, and mercury vapor lamps, and materials such as volatile metal halides. In one embodiment, the toner or ink may not comprise a photoinitiator if an electron beam is used as a radiation source. An electron beam penetrates more deeply into the substrate than other radiation sources, and smaller quantities, or even the absence, of photoinitiators or co-initiators, will provide complete curing of the toner.

The radiation or photo source may be in-line with the electrographic or electrostatic printing device, and, for example, may be positioned at the fusing rollers. When the toner is fused or melted at the fusing rollers, the molten toner may be exposed to radiation. The cross-linking reaction occurs when heat energy is applied at fusing rollers. The radiation curing occurs when the molten toner is exposed to radiation. Near infrared (IR) may be used as a radiation source to simultaneously heat, crosslink and radiation cure the toner components, since near IR can simultaneously generate both heat and radiation.

The radiation source may also be used in conjunction with heat transfer of the image as a post-printing step. In this embodiment of the process, no crosslinking or curing occurs during the electrographic or electrostatic imaging onto a substrate. The heat activated reaction occurs upon the application of heat to transfer the image from the printed substrate onto the final substrate. Radiation curing may occur simultaneously with, or after, the heat transfer step. If the radiation curing occurs afterwards, additional IR heating may be needed to melt the printed toner that forms the image. The radiation source is then applied to further cure the transferred image. Again, near IR may be used as radiation source to provide heat for the crosslinking reaction, as well as a radiation source for curing the toner.

A catalyst may be provided to catalyze the cross-linking reaction of the electrophilic and nucleophilic reactive species. Examples of suitable catalysts include tertiary amines, such as triethylene amine, triethylenediamine, hexahydro-N,N'-dimethyl aniline, tribenzylamine, N-methyl-piperidine and N,N'-dimethylpiperazine; heterocyclic nitrogen compounds, such as 1,5-diazobicyclo[4.3.0]non-5-ene and diazobicyclo[2.2.2]octane; alkali or alkaline earth metal hydroxides; heavy metal ions, such as iron(III), manganese (III), vanadium(V) or metal salts such as lead oleate, lead-2-ethylhexanolate, zinc(II) octanoate, lead and cobalt naphthenate, zinc(II)-ethylhexanoate, dibutyltin dilaurate, dibutyltin diacetate, and also bismuth, antimony and arsenic compounds, for example tributyl arsenic, triethylstilbene oxide or phenyldichlorostilbene. Preferred catalysts include heterocyclic nitrogen compounds and dibutyltin catalysts.

Colorants for the ink or toner may be dyes or pigments, or a combination. Suitable dyestuffs include, but are not limited to, pigments, Acid Dyes, Direct Dyes, Reactive Dyes, Basic Dyes, Solvent Dyes, Disperse Dyes, Reactive Disperse Dyes, Sulphur Dyes, or Vat Dyes, or a combination thereof. Colorants containing a hydroxyl, amine, carboxylic, or other active hydrogen containing functional group that is capable of reacting with an electrophilic cross-linking agent without altering the desired hue are useful, particularly those that contain at least one alkoxy or alkylamino group. Examples include Disperse Red 55, Solvent Red 117 and Disperse Blue 3. Other examples are described in U.S. Pat. Nos. 4,749,784 and 6,159,250. These colorants can be used alone, or as multiple colorants of the same type or of a different type. It is preferred to use a combination of pigment and disperse dyes when polyesters, EVA, polyamides or the like are used as binder resins or as reagents, in order to achieve good color strength, light fastness and wash fastness of the permanently affixed image. Pigments and dyes may be incorporated into a flush resin system for easier dispersion within the toner system. Examples of flushed colorants are Sun Phthalo Blue-Green Shade 15 and Sun Diaryl Yellow AAOT 14 (Sun Chemical), and Hostacopy E02-M 101 Magenta (Clariant). The toner may contain from 0–30% colorant by weight. Colored toner will preferably contain between 4–15% colorant by weight.

The toner must produce an adequate charge magnitude, charge sign, rate of charge, and charge stability with time. Internal and/or external charge control additives are added to the toner composition as necessary to achieve the desired charging behavior. Depending upon the specific characteristics of the electrographic printer, either positive or negative charge control additives may be incorporated. Colored or colorless quaternary ammonium salts and onium charge control agents may be used as positive charge control additives and metal complexes, while acidified carbon blacks or fumed silica surface additives are examples of negative charge control additives. The toner may comprise 0.01 % to 10% charging additives, preferably 0.1% to 3% (by weight).

Other printing additives may be added in the toner composition, such as flow control agents or humidity scavengers. Combination of various charge control agents, flow control agents or other additives may also be used in order to enhance the performance of the toner in the present invention.

The heat and radiation dual-curable toner may be prepared using conventional compounding techniques, such as dry-mixing the ingredients, melt-mixing using a roll mill or single or twin screw extruder, and micronizing, using, for example, an air jet mill. Microencapsulation techniques may be utilized to encapsulate the conventional prepared toner particles containing resins having a low glass transition temperature to enhance properties such as toner powder stability. The microencapsulation techniques may also be utilized to prepare toner particles in conjunction with non-conventional techniques, such as chemical toner formulation by suspension polymerization or emulsion polymerization. Other non-mechanical techniques may be used to prepare the whole toner. In general, the toner can be produced by either technique, with the resulting toner having an average particle size from 0.1 to 25 microns.

In use, the toner is printed on a substrate to form a desired image. The image is permanently fixed to the substrate, or it is transferred to another substrate on which the image is to permanently appear, which is sometimes referred to as the final substrate. Virtually any material which can be printed upon by a conventional electrographic device, such as a laser printer or photocopier, and which will withstand the fusing/fixation process may be used as a substrate. Various fusing/fixation processes include, but are not limited to, solvent, radiant, and combinations of heat and/or pressure. This substrate may be any material commonly used with electrographic printers or copiers, such as copier paper or bond paper. Other sheets of material that may be handled by the device may be used as a receiver substrate, and these materials may include cloth, metal, plastic or glass. A sheet of release paper may be used as a receiver substrate or intermediate substrate if the image is to be transferred to a final substrate. A release paper may be a sheet coated with any low surface energy material, for example, a silicone polymer or a fluorocarbon resin, such as polytetrafluoroethylene, or any other release agent, such as carboxymethlycellulose. The coat weight of release material is generally from 0.4–10 g/m$^2$ on the base sheet. "Release force" is typically used to describe the force required to remove something from the liner/basesheet, and may be subjectively described as 'easy' or 'tight'. The release force may be adjusted by the selection of coating formulations and resulting polymer characteristics, or by coat weight. Optimally, the release force is such that it is high ('tight') enough such that the toner adheres during and after the fusing step in the printer and any subsequent handling of the printed image, but not so high that the toner is not substantially released from the sheet during transfer to a final substrate ('easy release').

In transfer printing, after the image is printed onto a receiver or intermediate substrate, the image may be subsequently permanently transferred to a final substrate, either presently or at a later time, independently of the electrographic device. The image may be transferred onto virtually any object, including textile articles, such as shirts, or metal, ceramic, wood, or plastic articles. Other final substrates are natural, semi-synthetic or synthetic textiles, natural textile materials (including wool, silk, hair and cellulosic materials, such as cotton, jute, hemp, flax and linen), or blends of those materials. Examples of synthetic and semi-synthetic materials include polyamides, polyesters, polyacrylonitriles and polyurethanes. Textile materials may be a blend of natural and synthetic fibers, or a blend of different knitting or weaving patterns.

To prevent premature, or undesired, crosslinking or reactions, the nucleophilic and/or electrophilic functional groups may be protected either by chemical blocking with, or without, additional blocking agents, or by internally or externally blocking, or by providing a physical barrier, such as an encapsulating wall or shell. Through the use of blocking, the second reagent may be present with the first reagent in the toner. Alternatively, the second reagent may be printed to the same area as the first reagent from a separate ink or toner reservoir. The protecting agents may be removed after printing by the application of heat or other energy. Other initiators include, but are not limited to, radiation, hot aqueous steam, and chemical and mechanical means, and/or combinations thereof.

The toner is fixed onto the final substrate by removing the protecting or blocking agent(s) from the reactive components. Energy, such as heat, hot steam, radiation, pressure or a combination, as appropriate to the toner, is applied, the reagents are allowed to react with each other, and/or with active hydrogen-containing groups that are present on the final substrate. For example, transfer may be accomplished by the application of heat at 200° C., and the simultaneous application of pressure, for twenty (20) seconds. Since heat activation of the reactive components occurs during the transfer step, which is prior to and independent of printing, images may be stored for long periods of time on a receiver sheet or an intermediate substrate.

The choice of protecting agents is dependent in part upon the printer device to be used. For example, if a laser printer device uses heat and pressure to fuse the image to the substrate, and the effective fuser roller temperature is approximately 150° C., a chemical blocking agent will be chosen to produce an unblocking temperature that is above 150° C., but not more than the transfer temperature, for example, 200° C. The choice of blocking agents will be dependent not only upon the fusing temperature, but also the residence time of the toner in the fusing system. Examples of thus protected electrophilic reactive ingredients include internally (also known as blocking agent-free) and externally blocked polyisocyanates. An example of an internally blocked polyisocyanate is the isophorone diisocyanate (IPDI) product, Crelan VP LS 2147 from Bayer. Common examples of external blocking agents include phenols and substituted phenols, alcohols and substituted alcohols, thiols, lactams, mercaptams, primary and secondary acid amides, imides, aromatic and aliphatic amines, active methylene compounds, oximes of aldehydes and ketones and salts of sulfurous acid. An example of an externally blocked polyisocyanate is the $\epsilon$-caprolactam blocked Vestagon EP B 1400 from CreaNova.

Physical barriers or encapsulation techniques not only provide protection of the nucleophilic and/or electrophilic functional groups, to prevent premature or undesired crosslinking reaction, but may also protect other components, such as radiation-curable and soft resins or liquid materials, if present, to ensure good toner powder stability and flow upon melting.

Microencapsulation techniques have been used in number of different fields. In microencapsulation, small solid particles, liquid droplets, or gas bubbles are enveloped with a wall or shell. The encapsulation processes are divided in several categories include physical processes such as co-extrusion and other phase separation processes, in-liquid curing, fluidized-bed coating or the Wurster process, spray drying, interfacial polymerization or in situ polymerization, and polymer-polymer phase separation or simple/complex coacervation, desolvation, centrifugal encapsulation, bi-liquid column process, electrostatic encapsulation, vapor deposition of coatings, solvent evaporation, gelation encapsulation, powder bed, ethylene polymerized around cellulose fibers, and spray freezing.

The preferred microencapsulation technique is able produce a particle size of 0.1 to 25 $\mu$m. One useful technique to encapsulate the lower glass transition temperature resin, is core-shell emulsion polymerization. In general, emulsion polymerization generates droplets of about 100 nm. Soft monomers with lower glass transition temperatures (Tg) polymerize in the first stage of emulsion polymerization, followed by the addition of monomers with higher Tg. For chemically prepared toner, a controlled agglomeration is needed to achive a particle size of 1 to 20 □m. Suitable soft monomers include butyl acrylate, butyl methacrylate, ethyl acrylate, ethyl methacrylate, 2-ethylhexyl acrylate, 2-ethylhexyl methacrylate, isobutyl acrylate, isobutyl methacrylate, stearyl methacrylate, lauryl methacrylate, or similar, and combinations thereof. Suitable hard monomers include styrene, a-methyl styrene, methyl acrylate, methyl methacrylate, ethyl methacrylate, acrylic acid, methacrylic acid, or similar, and combinations thereof.

The encapsulation wall or shell in the present invention may be a resin or material with a glass transition temperature that is greater than 50° C. It is preferred that the encapsulated reagents, liquid ingredients, and soft resins remain inside the shell during toner preparation, processing, handling, transporting, storage and printing. The encapsulated ingredients are activated by applying heat or pressure to break the wall or shell.

In still another embodiment of the present invention, the electrophilic and nucleophilic reactive groups may be contained in separate toners or inks. For example, a toner in one cartridge may contain a compound or compounds with functional groups that react with active hydrogen, while another cartridge may contain a compound or compounds, containing active hydrogen.

It is noted that electrographic systems of the present invention may use reactive toner in either a mono-component or a two-component developer. While the mono-component developer is composed of a toner only, the two-component developer is composed of a toner and a carrier (e.g. iron powder, ferrite powder, magnetite powder, etc.). Dual component dry electrographic copier/printer toners are typically mixed in a ratio of one part toner of the desired color to ten parts of a carrier iron powder (for example, EFV 250/400, Nippon Teppun Co., Ltd.) to form developers in each of the desired colors. Mono-component toner may be made magnetic/nonmagnetic, and conductive/nonconductive to suit the engine design of the electrographic device. Magnetite and carrier materials can be added depending on the specific application. In mono-component applications, magnetite is added to enable the transport of the toner through the developer housing, and against the latent image, under magnetic control. The addition of magnetite also offers an advantage in two-component development, by controlling machine dirt even though the loading of such materials is much smaller than the single-component applications. The carrier provides basically two important functions in dual-component toner: charge generation and transport through the developer housing. The carrier can be comprised of either magnetic or nonmagnetic materials. Typical nonmagnetic carriers include particles such as glass beads, crystals of inorganic salts in crystal forms of sodium or potassium chlorides, metal particles and hard resin particles, and similar materials. Magnetic carrier particles include ferromagnetic materials comprised of iron, cobalt, or nickel in the form of an alloy or a mixture, and with or without film-forming resin coatings to improve the toner triboelectric properties of the particles.)

The toners may be formulated to produce phosphorescent, iridescent, or fluorescent, images or to have biological activity.

Full color images may be produced from combinations of cyan (C), yellow (Y) and magenta (M) toner. Process black (K) may also produced from these three colors. The fourth cartridge, usually occupied by black toner in prior art application, is provided with a colorless toner or white toner that is printed on the substrate and over the entire area to be imaged, but not beyond the outer perimeter of the area to be imaged, prior to printing C, Y, M and/or K. This optional colorless toner provides additional color vibrancy (V), wash fastness and/or light fastness to the transferred image and/or provides improved transfer efficiency of the image from the intermediate substrate to the final substrate. Alternatively, five cartridges may be used, which provide for C, M, Y, K and a colorless toner (V), or any spot colors. Again the colorless toner is printed onto the intermediate substrate over the entire area to be imaged, followed by the colored toners. Alternatively, the colorless toner may be printed over the colored image. Any combination of colored toners may be used. More than one cartridge may contain colorless toner.

The optional colorless toner (V) may comprise heat and radiation curable reagents. Preferably, the radiation-curable compounds will also comprise radiation-curable ethylenic unsaturated species, capable of free radical polymerization. Examples are unsaturated polyesters, e.g. maleic polyesters. The addition of one or more additives as previously may be used as is advantageous to the application. Additives include reactive fusing agents, charge control additives and silica. The colorless toner may be comprised of the same ingredients as any of the above-described colored toners, except that no colorant is provided.

The optional colorless toner (V) may comprise the nucleophilic and/or electrophilic reactive species discussed above. The colorless toner (V) may also comprise heat-meltable compounds. The heat-meltable compounds are preferred to comprise nucleophilic reactive species and radiation-curable species, capable of reacting with, for example, polyisocyanate. Examples are oxidized polyethylene and polypropylene waxes, oxidized Fischer Tropsch waxes, and grafted maleic polymers. Addition of one or more additives as previously described may be advantageous, such as reactive fusing agents, charge control additives and silica. The colorless toner may be comprised of the same ingredients as any of the above-described colored toners, except without colorant.

In another embodiment of the present invention, colorless toner (V) is printed over or under an image, and only in the imaged area, or alternatively, slightly beyond the perimeter of the imaged area. For example, an image is first printed onto a sheet or other substrate by means of a toner or ink containing disperse, or sublimation, dyes. The colorless toner is then printed over the image, so as to cover the entire image, but the colorless toner is not printed materially beyond the perimeter of the image. Alternatively, the colorless toner is first printed onto a sheet or other substrate over the entire area to be printed with an image. The image is the printed with, for example, toners or inks containing disperse dyes. As a further extension of this embodiment, a printed image may be 'sandwiched' between layers of colorless toner. The overprinted and/or underprinted image is then transferred to a final substrate by application of energy, i.e., heat, to the backside of the image receiver sheet. The resulting transferred image has excellent image definition, color vibrancy and wash fastness, even when transferred to natural fibers, or a combination of natural and synthetic fibers. Multiple toner cartridges may contain the colorless toner (V). The color image may be printed by the same electrographic printer that prints the colorless toner, or the image and the colorless toner may be printed in separate steps by remote electrographic printers, or the printing may be performed by conventional or digital printers, such as offset printers, or an inkjet or wax thermal printers.

When the colorless toner is printed over the colored image, the colorless toner may be printed simultaneously with a colored toner image, or the colorless toner may be printed at a later time. "Simultaneously," as used in this paragraph, means that the colored toner is in one or more cartridges and the colorless toner is in the remaining cartridge or cartridges, all in the same printer, and the colored and colorless toner are printed in 'one pass' through the printer. When printed under the colored image, the colorless toner may be printed simultaneously with, or prior to, printing the colored image.

The use of a color management process is preferred so that the apparent color of the image as printed on the final substrate faithfully reproduces the color of the original image. The color management process defines a method of converting the color values of a digital image from an input color space ($CS_i$) to the corresponding color values of a substrate color space ($CS_s$) while maintaining the visual color components. This process is unique for each combination of printer, final substrate, toner set, fixing/transfer device, and/or paper or intermediate substrate variables. A color correction and color management process is described herein. The term "transfer/fixing" is used to describe either: 1) a process of printing onto a medium (receiver sheet or intermediate substrate), then transferring the image to a final substrate, or 2) printing directly onto the final substrate and fixing the image to the final substrate.

Characterize the Output Device

Device characterization ensures that the density of the image on the target substrate matches the density requested by the print application. If the print application requests a 22% density square of black, a properly characterized device will produce output that will transfer to a black square of 22% density to the target substrate. If the device is not properly characterized, the final substrate will not accurately reproduce the target colors. For printed output, device characterization is accomplished by measuring the density of the printed output against a known target value. For the transfer process, device characterization must be extended to include the combination of variables represented by the device, the color toner set, the colorless toner, and the final substrate.

To characterize a device for the toner (including the optional colorless toner layer in the V channel, if used) and substrate combination, a table of input (stimulus) and adjustment (response) data pairs is built. This table represents the channel output values that need to be sent to the printer in order to reproduce the density on the output substrate that matches the density of the input value.

The substrate characterization process includes the combination of devices and materials associated with transfer or fixing of the image onto various final substrates. Considerations of parameters being used by these devices can also be critical to the quality of the image reproduction. Only the characterization of each combination of digital input/output devices, transfer/fixing devices, transfer mediums, and final substrates can ensure the required quality of the final product. Temperature, pressure, time, medium type, moisture level, second degree dot size change and color degradation, interrelation between toner with the media and final substrate, etc. are examples of such parameters.

The characterization table is built by sending a set of data points (stimuli) to each color channel of the printing device. The data points represent a gradation of percentage values to be printed on each of the print device's color channels (from 0 to 100%). To make this process accurately reflect the final output, considerations must be given to potential application of colorless toner layer and transfer or fixation process to a final substrate before the response measurements are taken. Using a densitometer, the densities of each color channel on the transferred output are read from the substrate. The maximum density is recorded, and a linear density scale is computed using the same percentage increments as the stimuli gradation scale. The corresponding densities from each scale are compared. For each step of the gradation, a response value is calculated. The response value is the percentage adjustment, negative or positive, that the stimulus value will be adjusted so the target output density will match the stimulus density. These stimulus/response data points are entered into the characterization table.

The stimulus/response tables are built through repeated iterations of creating the target density squares on the substrate, measuring the density, and adjusting the associated response value. A stimulus response table must be built for each color channel of the output device.

Define the Substrate Color Gamut

The process of creating digital output on a printing device and transfer/fixing the output onto a final substrate can reproduce only a finite number of colors. The total range of colors that can be reproduced on any final substrate is defined as the substrate color gamut. The substrate color gamut will vary for every combination of output device, transfer temperature, transfer pressure, transfer time, transfer medium type, substrate moisture level, and final substrate. The process of defining the total range of colors that can be reproduced on an output substrate is called substrate profiling.

Profiling a non-transferred color gamut is accomplished by printing a known set of colors to a print media, measuring the color properties of the output, and building a set of stimulus/response data points. To accurately define the substrate color gamut, profiling must be performed after the digital image is output to the transfer media and transferred/fixed onto a substrate.

To quantify the substrate gamut, a computer application capable of creating colors using a device independent color space (typically the CIE XYZ or L*a*b color spaces) is used to generate a representative set of color squares. These color squares are modified by adjusting the density values of each color channel according to the data in the characterization table, output to the printing device, and transferring/fixing the image onto the target substrate.

A color target consisting of a set of CIE based color squares is used to measure the output gamut. The color target is converted into the print devices color space (i.e. RGB into CMYK), each channel has the percent values adjusted by the response value stored in the characterization table, sent to the output device, and transferred/fixed to the target substrate. The calorimetric properties of the color squares are measured using a calorimeter and stored as a set of stimulus/response data pairs in a color profile table. This table is the data source used by software algorithms that will adjust the requested color of a digital image so that the image, when viewed on the target substrate, has the same calorimetric properties as the original image.

A color profile table is created for each combination of output device, transfer temperature, transfer pressure, transfer time, transfer medium type, and final substrate that will be used to transfer the digital image onto the final substrate.

Rasterization and Output of the Digital Image

If the original digital image is not in the same color space as the output device, (for example an RGB image is output to a CMY device), the image is converted into the color space required by the output device. If the output device requires a black color channel, the K component (black) is computed by substituting equal amounts of the CMY with a percentage of the black color channel.

For each pixel in the image, the color value is modified. The new value is equal to the response value stored in the color profile table when the pixel's original color value is used as a stimulus. The percentage values of each of the pixel's color channels are adjusted by the amount returned from the characterization table when the pixel's color modified percentage value is used a stimulus.

The transfer process may require an additional channel, V, for application of a colorless layer over and/or under the imaged area. The V channel is computed by reading the color value for each pixel location for each of the gamut-corrected color channels, C, M, Y, and K. If there is color data in any of the C, M, Y, or K color channels for that pixel, the corresponding pixel of the V channel is set to 100%.

The CMYKV digital image is halftoned using methods describe in the book "Digital Halftoning" by Robert Ulichney. The CMYK channels are converted into halftone screens according to standard algorithms. The V channel will primarily be processed as a solid super cell, i.e. the entire cell will be completely filled. This will ensure that the colorless toner layer is completely covered by any of the CMYK halftone dots. The data for all of the color channels are then sent to the output device.

To provide for the ability to create a V channel border around the image, proximity enhancement may be applied to each V channel pixel that will be printed. If V channel output is required at pixel (x,y), the pixel proximity value is varied from −m to m, setting the V channel value at pixel (x+mask, y+mask) to 100%, where m is the width, in pixels, of the desired V channel border.

EXAMPLE 1

A general heat and radiation dual-curable toner formulation for use with the method of the present invention is as follows:

| Component | Weight % |
|---|---|
| Dual-curable component | 0–95 |
| Radiation-curable components | 5–90 |
| nucleophilic binding material | 0–90 |
| electrophilic binding material | 0–90 |
| Non-reactive resin | 0–90 |
| Photoinitiator | 0.1–20 |
| Colorant(s) | 0–20 |
| Additives | 0–10 |

EXAMPLE 2

An example of a yellow toner formulation is given below with a 0.1/10 NCO/OH ratio:

| Component | Weight % |
|---|---|
| Uracross P 3125[1] | 47 |
| Uracorss P 3307[1] | 10 |
| Vestagon BF 1540[2] blocked isocyanate | 8 |
| Trimethylolpropane | 2 |
| Eastar Bio ® 14766[3] | 20 |
| Sun Diaryl Yellow AAOT 14[4] | 6 |
| Irgacure ® 184[5] | 5 |
| Dabco T-12 Caatalyst[6] | 1 |
| Bontron E85[7] | 0.5 |
| Aerosil R812[8] | 0.5 |

[1]Uracross P3125 is a UV-curable hydroxyl terminated unsaturated polyester resin from DSM, and Uracross P3307 is a UV-curable crystalline vinylether urethane resin from DSM.
[2]Vestagon BF1540 is a blocked isocyanate from CreaNova.
[3]Eastar Bio ® 14766 is a thermoplastic polyester from Eastman chemical.
[4]Sun Diaryl Yellow AAOT 14 is a yellow dye from Sun Chemical.
[5]A photoinitiator from Ciba Specialty Chemicals.
[6]Dabco T-12 Caatalystis a catalyst from Air Products chemicals.
[7]Bontron E85 is an internal charge control agent from Orient.
[8]Aerosil R812 is a charge control agent from Degussa.

EXAMPLE 3

An example of a cyan toner formulation is given below with a 1:1 ratio of NCO to OH:

| Component | Weight % |
|---|---|
| Uvecoat ™ 3000[9] | 40 |
| Uvecoat ™ 9010[9] | 20 |
| Crelan VP LS 2347[10] | 7 |
| Hostacopy C[11] | 6 |
| IRGACURE ® 1800[5] | 3 |
| Ecdel ® 9965[12] | 20 |
| Cibacet Blue F3R[13] | 2 |
| Dabco T-12 Catalyst[4] | 1 |
| Bontron E85[7] | 0.5 |
| Aerosil R972[8] | 0.5 |

[9]UVecoat 3000 is a methacrylyl ended UV-curable powder polyester resin, and Uvecoat 9010 is a semi-crystalline UV-curable methacrylyl ended polyester resin from UCB Chemicals.
[10]Crelan VP LS 2347 is a blocked isocyanate from Bayer.
[11]Hostacoppy C is a pigment from Clariant.
[12]Ecdel ® 9965 is a thermal plastic polyester from Eastman Chemicals.
[13]Cibacet Blue F3R is a pigment from Ciba Specialty Chemicals.

EXAMPLE 4

An example of a yellow toner formulation is given below with a 5/1 NCO/OH ratio:

| Component | Weight % |
|---|---|
| Uracross P 3125[1] | 20 |
| Uracorss P 3307[1] | 10 |
| Crelan VP LS 2147[10] | 40 |
| Trimethylolpropane | 1 |
| Eastar Bio ® 14766[3] | 16 |
| Monastral Red RT[14] | 6 |
| Irgacure ® 2959[5] | 6 |
| Bontron E85[7] | 0.5 |
| Aerosil R812[8] | 0.5 |

[14]Monastral Red RT is a pigment for UV-curing from Ciba Specialty Chemicals.

EXAMPLE 5

An example of a colorless (V) toner formulation is given below with a NCO/OH of 1.5:1:

| Component | Weight % |
|---|---|
| Uvecoat ™ 9010[9] | 70 |
| Irgacure ® 2959[5] | 5 |
| Ecdel ® 9965[12] | 6.5 |
| Crelan VP LS[9] | 12 |
| Urea | 5 |
| Bontron E89[7] | 0.5 |
| Aerosil R812[8] | 1.0 |

The present invention differs from the prior art cited above in several ways. By way of example and not limitation, these differences include that fact that a substrate does not need to be pre-treated in order to fix an image to the substrate. Second, many prior art processes are not transfer processes, wherein the electrographically printed image is transferred away from an intermediate or receiver substrate to a final substrate. Third, the prior art glass transition temperatures of UV-curable resins are above 35° C., even though it is known in the art that materials with lower glass transition temperature (<35° C.) result in improved "hand" on a textile substrate. Fourth, the UV-curable toner of the prior art generates a glossy image that is not desirable in textile printing.

Although the present invention has been fully described by way of the above detailed description and examples, various changes and modifications will be apparent to those skilled in the art. The example formulations and applications are given by way of demonstration, and are not exhaustive of the application of heat activated dyes to accomplish the printing method of the present invention using dry or liquid toners and electrographic devices. Those skilled in the art will recognize, or be able to ascertain using no more than routine experimentation, many equivalents to the specific embodiments of the invention specifically described herein.

What is claimed is:

1. A process of electrographic printing, comprising the steps of:

a. preparing a toner, wherein said toner comprises a first reagent and a second reagent, and wherein a reaction between said first reagent and said second reagent is blocked;

b. supplying an electrographic printer with said toner and printing a portion of said toner onto a substrate, wherein an image is formed by said portion of said toner that is printed onto said substrate; and c. reacting said first reagent and second reagent by exposing said image to heat and adhering said image to said substrate, and applying radiation energy to said image to form a cohesive bond within said image.

2. A process of electrographic printing as described in claim 1, wherein at least one of said first reagent and said second reagent is a crystalline material.

3. A process of electrographic printing as described in claim 1, wherein said toner has a glass transition temperature of 50° C. or less.

4. A process of electrographic printing as described in claim 1, wherein said substrate is a textile.

5. A process of electrographic printing as described in claim 4, wherein said textile comprises an hydroxyl group, and wherein said hydroxyl group reacts with said first reagent upon exposing said image to heat energy.

6. A process of electrographic printing as described in claim 1, wherein at least one of said first reagent and said second reagent comprises at least 10% crystalline material by weight.

7. A process of electrographic printing as described in claim 2, wherein said crystalline material is not a release agent.

8. A process of electrographic printing as described in claim 6, wherein said crystalline material is not a release agent.

9. A process of electrographic printing, comprising the steps of:

a. preparing a toner, wherein said toner comprises a first reagent and a second reagent, and wherein a reaction between said first reagent and said second reagent is blocked;

b. supplying an electrographic printer with said toner and printing a portion of said toner onto a receiver substrate, wherein an image is formed by said portion of said toner that is printed onto said receiver substrate; and c. transferring said image from said receiver substrate to a final substrate by exposing said image to heat energy and reacting said first reagent and said second reagent, and causing said image to transfer to said final substrate and adhere to said final substrate, and applying radiation energy to said image to form a cohesive bond within said image.

10. A process of electrographic printing as described in claim 9, wherein at least one of said first reagent and said second reagent is a crystalline material.

11. A process of electrographic printing as described in claim 9, wherein said toner has a glass transition temperature of 50° C. or less.

12. A process of electrographic printing as described in claim 9, wherein said final substrate is a textile.

13. A process of electrographic printing as described in claim 12, wherein said textile comprises an hydroxyl group, and wherein said hydroxyl group reacts with said first reagent upon exposing said image to heat energy.

14. A process of electrographic printing as described in claim 9, wherein at least one of said first reagent and said second reagent comprises at least 10% crystalline material by weight.

15. A process of electrographic printing as described in claim 10, wherein said crystalline material is not a release agent.

16. A process of electrographic printing as described in claim 14, wherein said crystalline material is not a release agent.

17. A process of electrographic printing as described in claim 9, wherein said receiver substrate is not a textile.

18. A process of electrographic printing as described in claim 12, wherein said receiver substrate is not a textile.

19. A process of electrographic printing as described in claim 17, wherein said receiver substrate is paper.

20. A process of electrographic printing as described in claim 18, wherein said receiver substrate is paper.

* * * * *